United States Patent [19]

Trainor et al.

[11] Patent Number: 5,053,825

[45] **Date of Patent: * Oct. 1, 1991**

[54] TONER SUPPLY CARTRIDGE HAVING PRIMARY AND SECONDARY BAFFLES

[75] Inventors: John W. Trainor, Vestal; Bruce E. Holtje, Castle Creek; Laura M. Gilbert, Vestal, all of N.Y.

[73] Assignee: Imagitek, Inc., Binghamton, N.Y.

[ * ] Notice: The portion of the term of this patent subsequent to Sep. 26, 2006 has been disclaimed.

[21] Appl. No.: 307,334

[22] Filed: Feb. 6, 1989

[51] Int. Cl.[5] ..... G03G 15/06

[52] U.S. Cl. ..... 355/260; 355/245; 222/DIG. 1

[58] Field of Search ..... 355/245, 260; 222/DIG. 1, 454, 166

[56] References Cited

U.S. PATENT DOCUMENTS

| | | | |
|---|---|---|---|
| 3,618,826 | 11/1971 | Kangas | 222/166 |
| 3,847,305 | 11/1974 | Tobin | 222/166 |
| 3,853,246 | 12/1974 | Dubois | 222/DIG. 1 X |
| 4,155,328 | 5/1979 | Navone | 222/DIG. 1 X |
| 4,349,132 | 9/1982 | Macaluso et al. | 222/DIG. 1 X |
| 4,688,926 | 8/1987 | Manno | 355/260 |
| 4,869,401 | 9/1989 | Holtte et al. | 222/DIG. 1 |

FOREIGN PATENT DOCUMENTS 0559517 2/1944 United Kingdom .

OTHER PUBLICATIONS

BNA Patent, Trademark and Copyright Journal, vol. 41, Bureau of National Affairs, Inc., Nov. 15, 1990, pp. 62–63.

1050 TMOG, pp. 319–323.

*Primary Examiner*—A. T. Grimley

*Assistant Examiner*—Matthew S. Smith

*Attorney, Agent, or Firm*—Kane, Dalsimer, Sullivan, Kurucz, Levy, Eisele and Richard

[57] ABSTRACT

This invention relates to an toner cartridge to dispense toner to a developing system in a photocopying device. The cartridge has a primary baffle thereby forming a main chamber and a dispensing chamber. The dispensing chamber is divided into a primary dispensing chamber and a secondary dispensing chamber by a secondary baffle. Apertures are formed in the container adjacent to the secondary dispensing baffle. The cartridge is designed to be rotated in one direction to fill the secondary dispensing chamber with toner, and then rotated in an opposite direction to dispense the toner from the secondary dispensing chamber through the apertures.

11 Claims, 4 Drawing Sheets

TONER SUPPLY CARTRIDGE HAVING PRIMARY AND SECONDARY BAFFLES

CROSS REFERENCE TO OTHER APPLICATIONS

The present application is a continuation-in-part of U.S. patent application Ser. No. 07/167,032 filed Mar. 11, 1988 for "TONER CARTRIDGE", now U.S. Pat. No. 4,869,401.

BACKGROUND OF THE INVENTION

The present invention relates to a toner cartridge for use with an associated drive mechanism of a copier for uniform dispensing of toner from the toner cartridge to the developer unit of the copier.

In the prior art of photocopying, particularly in two component development systems, the photocopying process depletes the toner concentration within the developer housing. In order to maintain a consistently high quality of reproduced image, it is necessary to maintain the toner concentration within the developer housing. Therefore, toner concentration within the developer housing is regularly replenished from a toner cartridge.

However, in the prior art, it has heretofore been difficult to control the amount of toner dispensed from the toner cartridge to the developer housing in view of (1) variations in both the viscosity or flow characteristics of the toner (which is ordinarily in a powder form which can become compacted or settled during periods of non-use) and (2) in the level to which the toner cartridge is filled which, of course, lowers with use. Any resulting inaccuracies in toner dispensing would result in fluctuations in both toner concentration and image quality.

It is therefore an object of the present invention to provide a toner cartridge apparatus for use within a photocopier which dispenses a uniform quantity of toner to the developer system regardless of the level to which the toner cartridge is filled.

SUMMARY OF THE INVENTION

The above and other beneficial objects and advantages are attained in accordance with the present invention by providing a toner cartridge including a system of internal baffles for use in apparatus provided with oscillating means.

The toner cartridge is in the shape of a cylinder with a length substantially equal to that of the developer housing of the associated copier in order to provide for uniform disbursement of the toner throughout the developer housing.

The toner cartridge includes a primary internal baffle to divide the cartridge into a main chamber and a dispensing chamber. The dispensing chamber includes apertures through which the toner is dispensed and over which a secondary internal baffle is positioned.

The cylindrical toner cartridge rotates about its longitudinal axis. In order to dispense toner, the toner cartridge is rotated through less than 360 degrees from a rest position in which the apertures pointed upward to a position in which the apertures point slightly downward from the horizontal. This "fluffs" the toner (powder) and provides for an amount of toner to pass from the main chamber into the dispensing chamber. The cartridge then reverses direction. As the apertures are pointed downward, a portion of the toner in the dispensing chamber is dispensed through the apertures. As the cartridge continues to rotate back to a position wherein the apertures are pointed upward, the non-dispensed toner in the dispensing chamber slides back into the main chamber where it continues to be fluffed. The dimensions of the dispensing chamber, the aperture size, and the flow characteristics of the toner determine the amount of toner dispensed in this operation.

FIGS. *3a, 3b, 3c, 3d, 3e, 3f, 3g,* and *3h* show the rotational/oscillatory cycle of the present invention.

Figure 4:
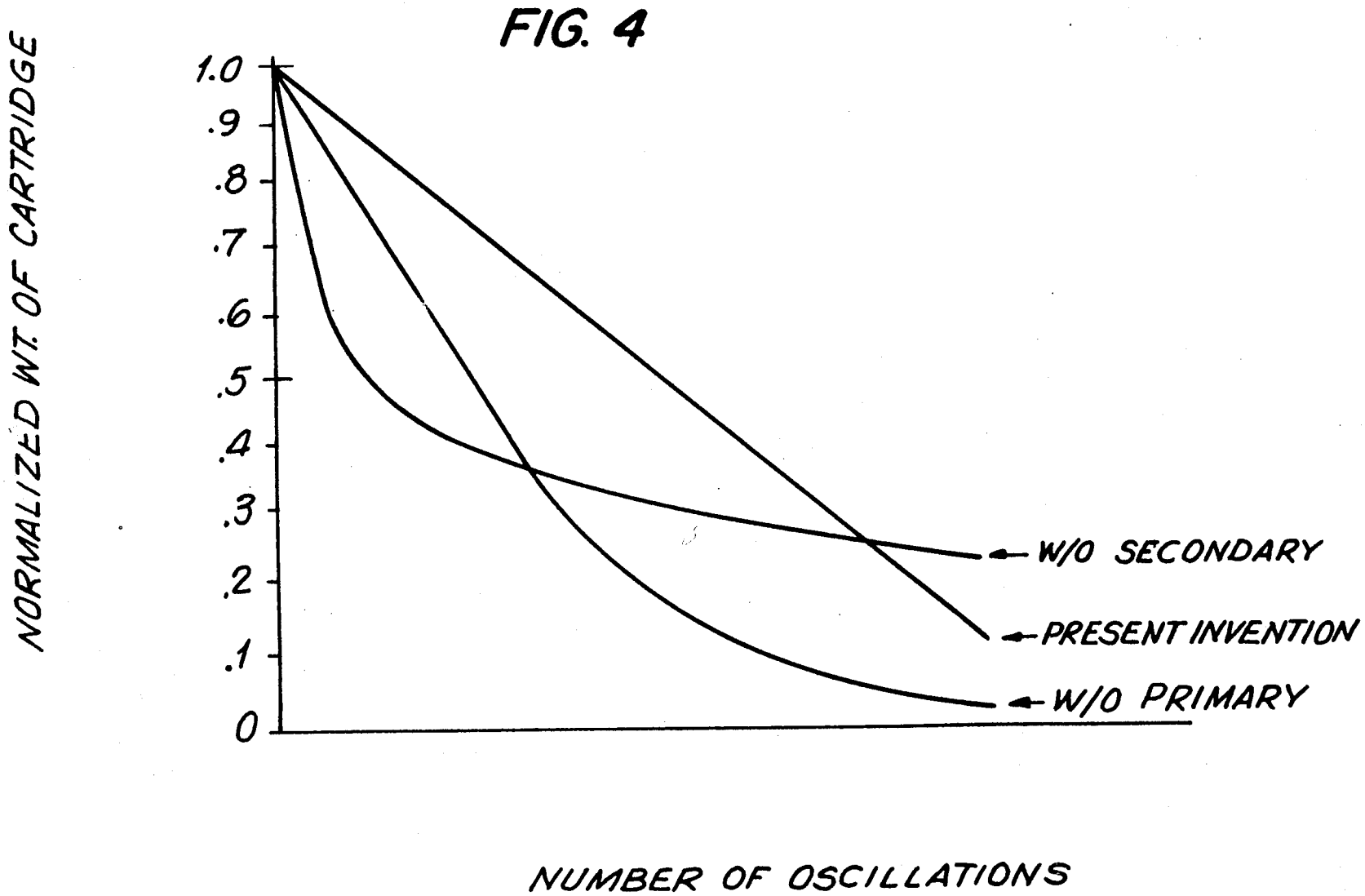

FIG. 4 shows a comparison of toner weight loss versus number of oscillations for the present invention and for a prior design which omitted the primary baffle.

FIG. 4 also is a graph showing toner weight loss for a different prior design which omitted the secondary baffle. It can be seen that both the primary and secondary baffle contribute to a uniform rate of toner dispensing over time and that omitting either the primary or secondary baffle impairs the performance of this invention.

DETAILED DESCRIPTION OF THE PREFERRED EMBODIMENT

Figure 1:
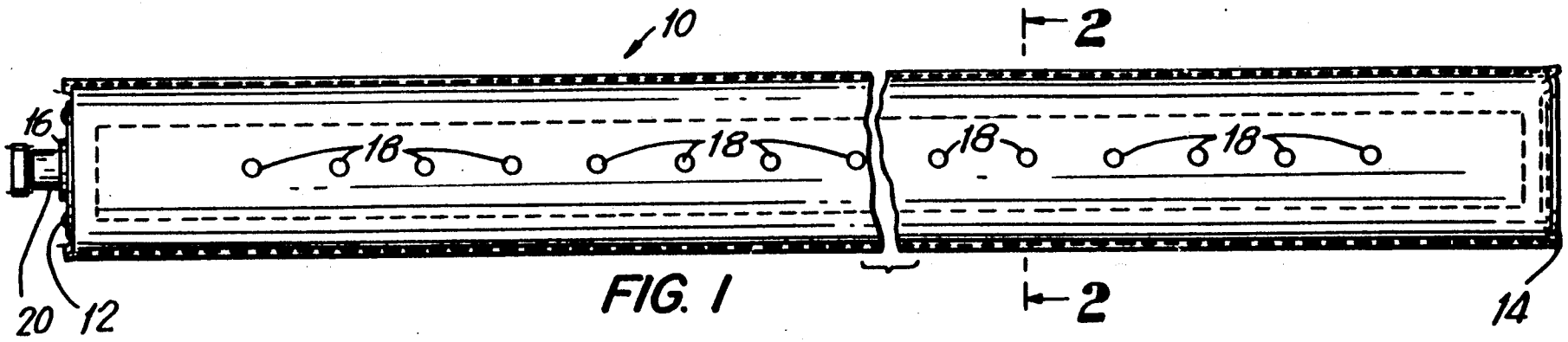
FIG. 1 is a front plan view of the present invention, positioned with the apertures pointed horizontally.

Referring now to the drawings in detail wherein like numerals indicate like elements throughout the several views, FIG. 1 discloses a front plan view of the toner cartridge apparatus 10. Apparatus 10 is of a hollow cylindrical shape with closed ends 12 and 14. Axle 16 extends from the longitudinal axis of apparatus 10. Apertures 18 are evenly spaced along a single linear longitudinal section of the surface of apparatus 10.

Rotating means 20, a gear or the like, is attached to axle 16.

Figure 2:
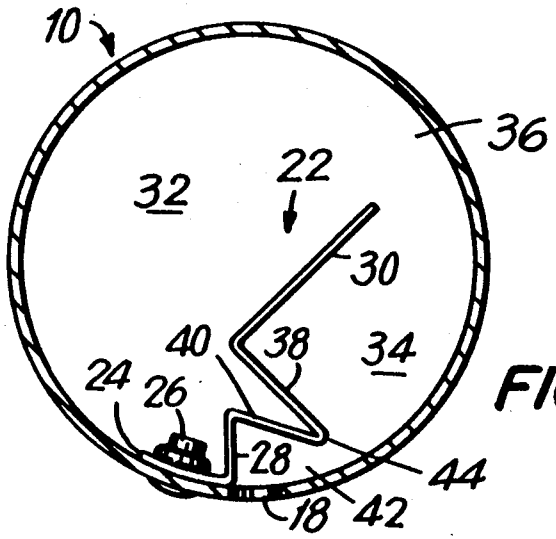
FIG. 2 is a side cross-sectional view of the present invention with the apertures pointed downwardly.

FIG. 2 discloses a cross-sectional view of apparatus 10. It will be recognized by those skilled in the art, that other cross sectional configurations may be possible and still realize the functional results described by this invention. Aperture 18 is shown in a downwardly pointing position. Baffle 22 is comprised of five sections—a connecting portion 24 which is held to the surface of apparatus 10 by rivet 26, an elevating section 28 which creates the dispensing chamber; primary baffle 30 which divides the interior of apparatus 10 into a main chamber 32 and a primary dispensing chamber 34, forming a primary slot 36 between chambers 32 and 34; and secondary baffles 38,40 which are folded over apertures 18 so as to create a secondary dispensing chamber 42 which communicates via secondary slot 44 to primary dispensing chamber 34.

Primary baffle 30 passes to the side of the longitudinal axis of apparatus 10 so as to make the main chamber 32 larger than primary dispensing chamber 34.

FIGS. *3a, 3b, 3c, 3d, 3e, 3f, 3g,* and *3h* illustrate the operation of apparatus 10.

FIG. *3a* discloses apparatus 10 in a non-dispensing mode with apertures 18 pointing upward. When control apparatus (not shown) senses that toner should be dispensed from apparatus 10, the apparatus 10 is rotated about axle 16 counter-clockwise by oscillatory means, not shown, (the "counterclockwise" direction is arbitrary and for purposes of understanding these figures only) less than 360 degrees, so that the apertures are pointing slightly downward from the horizontal. This movement causes the primary baffle 30 to lift and "fluff" the toner, breaking up any clots and assuring consistent and good flow characteristics. Additionally, a small amount of toner flows from main chamber 32 to primary dispensing chamber 34 through primary slot 36 and from primary dispensing chamber 34 through slot 44 to secondary dispensing chamber 42.

The flow of the toner through slots 36 and 44 further helps to break up clots and assure consistent flow characteristics. The flow of toner into secondary dispensing chamber 42 is limited by the width of secondary slot 44 and not by the quantity of toner within apparatus 10. This width, of course, is constant thereby assuring a consistent quantity of toner dispensed from apparatus 10.

Figure 3A:
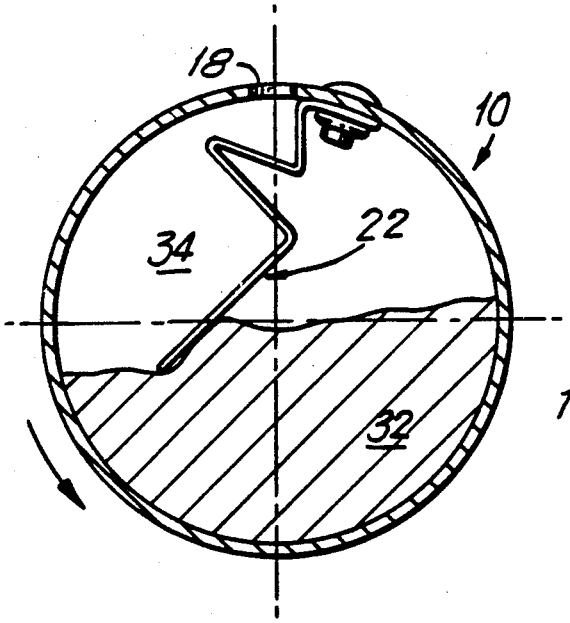
Figure 3B:
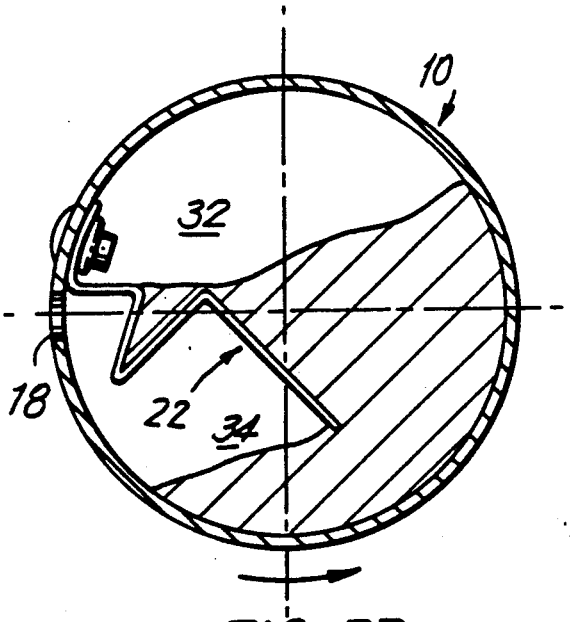
Figure 3C:
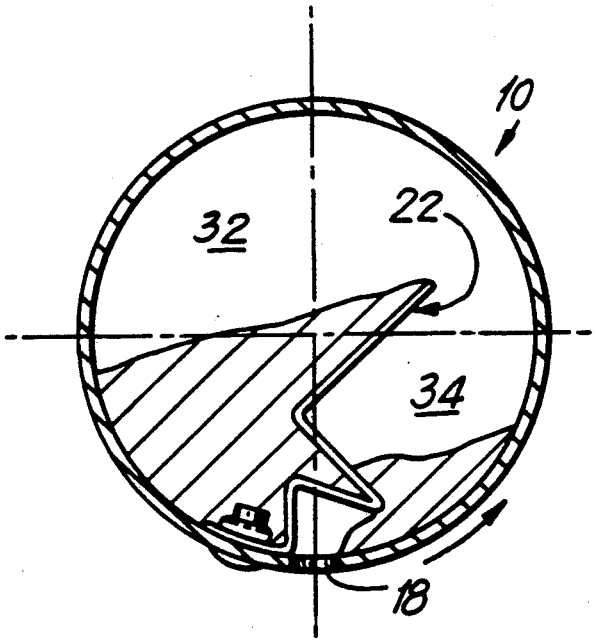
Figure 3D:
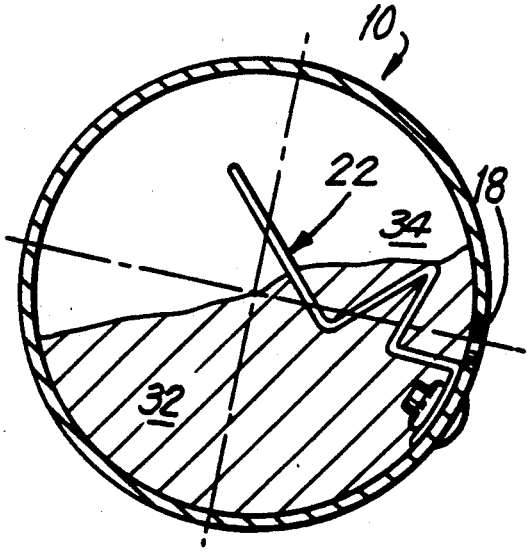
Figure 3E:
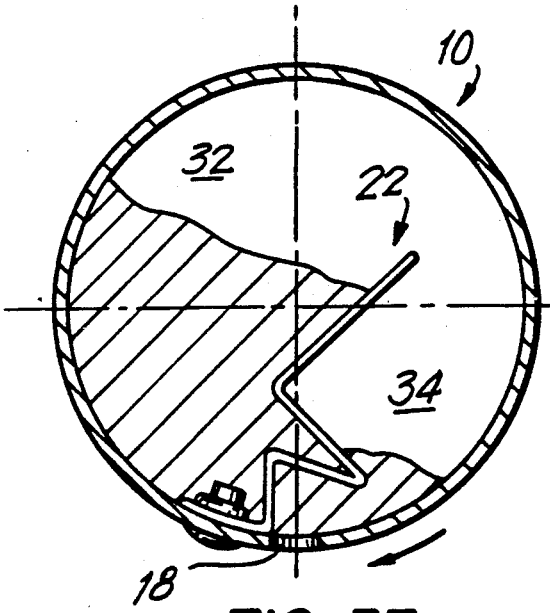
Figure 3F:
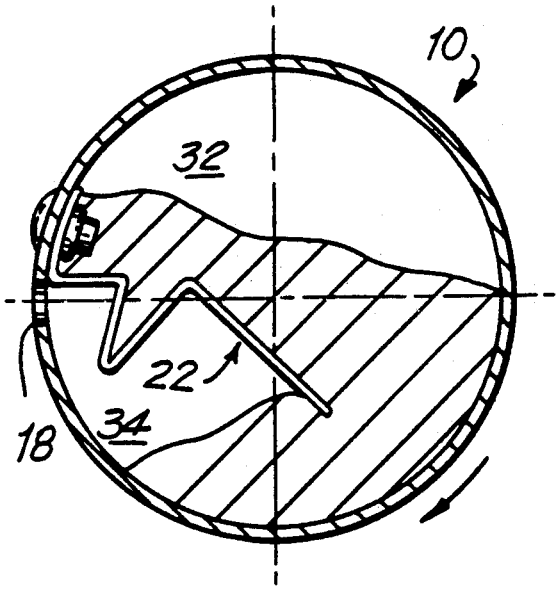
Figure 3G:
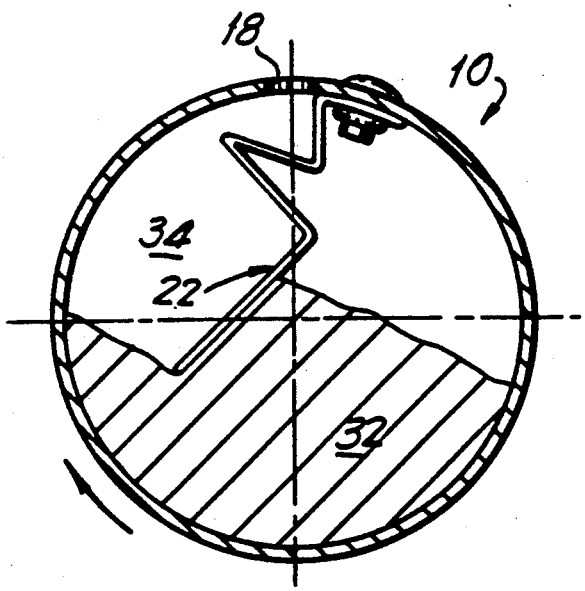
Figure 3H:
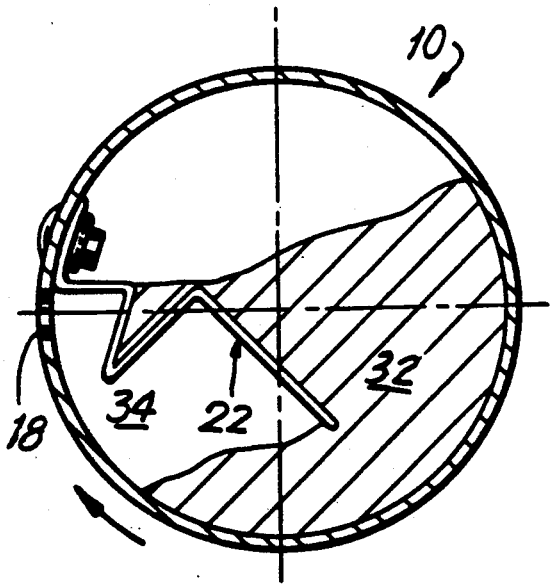

Oscillatory means (not shown) then reverses the direction of rotation of apparatus 10 and rotates the apparatus 10 in a clockwise (again, "clockwise" is arbitrary and only for the understanding of the enclosed figures) direction to the position shown in FIG. 3*e* wherein the toner is dispensed from secondary dispensing chamber 42 through apertures 18. The apparatus 10 continues to rotate in this (arbitrary) clockwise direction through the position shown in FIG. 3*f* to return to the ending position shown in FIG. 3*g*, which is the same as the starting position shown in FIG. 3*a*. FIG. 3*h*, corresponding to FIG. 3*b*, illustrates the repeating nature of the process.

FIGS. 4 and 5 illustrate the superior performance of the present invention over the prior designs in that the toner weight loss versus number of oscillations is markedly straighter for the present invention than for prior designs. This straight line, or constant first derivative, characteristics demonstrates the more nearly uniform amount of toner dispensed with each oscillation.

Thus, in accordance with the above, the aforementioned objects are attained.

What is claimed is:

1. An apparatus for dispensing toner in a photocopying device, comprising:

a container;

a primary baffle inside said container dividing said container into a main chamber and a dispensing chamber;

a secondary baffle inside said container dividing said dispensing chamber into a primary dispensing chamber and a secondary dispensing chamber; and at least one aperture passing from said secondary dispensing chamber, through said container, through which the toner passes in a metered fashion.

2. The apparatus of claim 1 wherein said primary and secondary baffles are parallel to a longitudinal axis of said container.

3. The apparatus of claim 2 wherein said container is rotationally symmetric about said longitudinal axis.

4. The apparatus of claim 3 wherein said container is cylindrical.

5. The apparatus of claim 2 further including rotating means so that said container rotates about said longitudinal axis.

6. The apparatus of claim 5 further including means adapted to engage a rotary drive whereby to rotate said container by said rotary drive in a predetermined cycle so as to fill said secondary dispensing chamber with toner and dispense the toner through said at least one aperture.

7. The apparatus of claim 6 wherein said predetermined cycle includes rotating said container in a given direction between 180 and 360 degrees from a first position and rotating said container in a direction opposite said given direction to return said container substantially to said first position.

8. The apparatus of claim 7 wherein said at least one aperture is pointing substantially straight upward in said first position.

9. The apparatus of claim 6 wherein said predetermined cycle includes rotating said container in a given direction between 180 and 280 degrees from a first position and rotating said container in a direction opposite said given direction to return said container substantially to said first position.

10. The apparatus of claim 9 wherein said at least one aperture is pointing substantially straight upward in said first position.

11. A method for dispensing toner in a photocopying device comprising the steps of:

rotating a container in a given direction thereby supplying toner from a main chamber within said container past a first baffle to a primary dispensing chamber within said container and supplying toner from said primary dispensing chamber past a second baffle to a secondary dispensing chamber within said container; and rotating said container in a direction opposite said given direction thereby dispensing toner from said secondary dispensing chamber through apertures in said container in a metered fashion.

* * * * *